US005888629A

United States Patent [19]

Lubar

[11] Patent Number: 5,888,629

[45] **Date of Patent: *Mar. 30, 1999**

[54] INK JET RECORDING MEDIUM

[75] Inventor: Michael J. Lubar, Endicott, N.Y.

[73] Assignee: Azon Corporation, Johnson City, N.Y.

[ * ] Notice: This patent issued on a continued prosecution application filed under 37 CFR 1.53(d), and is subject to the twenty year patent term provisions of 35 U.S.C. 154(a)(2).

[21] Appl. No.: 651,458

[22] Filed: May 22, 1996

Related U.S. Application Data

[60] Provisional application No. 60/005,204 Oct. 12, 1995.

[51] Int. Cl.[6] ..... B41M 5/00

[52] U.S. Cl. ..... 428/212; 428/195; 428/323; 428/328; 428/331; 428/478.2

[58] Field of Search ..... 428/478.2, 195, 428/478.8, 480, 500, 212, 323, 328, 331

[56] References Cited

U.S. PATENT DOCUMENTS

| | | | |
|---|---|---|---|
| 4,481,244 | 11/1984 | Haruta et al. | 428/155 |
| 4,785,313 | 11/1988 | Higuman et al. | 346/135.1 |
| 4,857,386 | 8/1989 | Butters et al. | 428/206 |
| 5,190,805 | 3/1993 | Atherton et al. | 428/195 |
| 5,206,071 | 4/1993 | Atherton et al. | 428/195 |
| 5,374,475 | 12/1994 | Walchlf | 428/304 |
| 5,532,064 | 7/1996 | Lubar | 428/478.2 |
| 5,560,982 | 10/1996 | Sato | 428/216 |

*Primary Examiner*—Pamela R. Schwartz
*Attorney, Agent, or Firm*—Gifford, Krass, Groh, Sprinkle, Anderson & Citowski, P.C.

[57] ABSTRACT

A medium for ink jet imaging includes a bottom layer of material having a very high absorption for the polar, solvent component of an ink jet imaging ink, together with a top layer of image receptor material disposed in fluid communication therewith. The bottom layer has a very high affinity for the solvent component of the ink and tends to draw the solvent from a body of ink thereby preventing image spread and producing a localized, highly saturated image.

18 Claims, 2 Drawing Sheets

INK JET RECORDING MEDIUM

This application claims the benefit of U.S. Provisional Application No. 60/005,204 filed Oct. 5, 1995.

FIELD OF THE INVENTION

This invention relates generally to recording media of the type which are absorptive of ink. More specifically, the invention relates to recording media for use in an ink jet imaging process, which are highly absorbing of ink, and which provide an imaged sheet having a tack-free, non-blocking surface.

BACKGROUND OF THE INVENTION

Ink jet printing is a process whereby a stream of ink, preferably in the form of droplets, is propelled against a medium so as to create an imagewise pattern, and while the present invention may be utilized in any recording medium of the type which imbibes a fluid ink, the primary utility of the present invention is in the production of ink jet recording media; and accordingly, will be explained primarily in that context.

Media used for ink jet recording must be dimensionally stable, absorptive of ink, capable of providing a fixed image, and compatible with imaging materials and hardware. In many instances, ink jet printing is carried out on simple paper media, particularly in those instances where correspondence and the like is being reproduced. However, certain applications will require that ink jet printing be carried out on a medium having a transparent base. Such applications include the production of backlit graphic displays, decals, posters and banners.

Particular problems arise when ink jet imaging is carried out on transparent media, and these problems are further enhanced when backlit images are produced. The typical inks employed in ink jet processes have a fairly high solvent content, and the solvents generally include high boiling, slow drying, relatively polar materials such as glycols, glycol ethers and water. The presence of fairly large amounts of relatively high boiling solvents in the medium can result in the production of an image having a tacky and/or greasy feeling surface. As a result, problems of blocking, smearing and image spread can occur.

One approach to these problems is detailed in U.S. Pat. No. 5,374,475, wherein an ink jet imaging medium is disclosed, which has an outer surface comprised of a non-ink-absorbing layer of material having a plurality of capillary passages defined therethrough which communicate with an ink receptive layer. An analogous approach is taken in patents 4,785,313 and 4,481,244 wherein a top, preferably porous, low absorbency layer is used to convey ink to a receptor layer therebeneath. Another approach is disclosed in U.S. Pat. No. 5,190,805, which shows an imaging medium which includes a hydrogel comprised of a complex of a comb graft copolymer together with relatively large amounts of a water soluble polymer. The hydrogel functions as an image receptor and requires the presence of significant amounts of pigment therein in order to enhance drying of the ink, and to limit lateral image diffusion. In some instances, a top coat may be present, provided it is fabricated from a material having an ink absorbtivity greater than that of the hydrogel.

In contrast, the present invention, is directed to an imaging medium having an image receptor layer on the top surface thereof, and a high absorbtivity, solvent imbibing layer therebeneath. The present invention provides an imaging medium which is durable, stable and receptive to a variety of inks including pigment based inks as well as dye based inks. The medium of the present invention provides a dry to the touch image which does not smear, block or spread. These and other advantages of the present invention will be apparent from the drawings, discussion, description and examples which follow.

BRIEF DESCRIPTION OF THE INVENTION

There is disclosed herein a medium for use in an ink jet imaging process of the type which employs an ink comprised of a coloring agent and a polar solvent. The medium includes an absorber layer which is supported by a substrate. The absorber layer is comprised of a hydrogel formed from a water insoluble, hydrophilic polymer and a water soluble polymer. The hydrogel has a higher affinity for the polar solvent of the ink than it does for the colorant of the ink. An image receptor layer is supported by the absorber layer in fluid communication therewith. The image receptor layer has a higher affinity for the coloring agent of the ink than it does for the ink's polar solvent.

In some particular instances, the water insoluble polymer of the absorber layer is a comb graft copolymer and it is present in an amount which is at least as great as the amount of the water soluble polymer. The absorber layer may be a homogeneous layer of material which is free of particulate matter. The receptor layer may comprise a gelatin based layer and in some particular embodiments is loaded with a particulate material such as a pigment.

BRIEF DESCRIPTION OF THE DRAWINGS

FIG. 2 depicts the medium after a body of ink has been applied to the upper surface thereof;

FIG. 3 depicts the medium of FIG. 2 showing partial penetration of ink therethrough;

FIG. 4 depicts the medium of FIG. 2 showing the penetration and absorption of ink thereby.

DETAILED DESCRIPTION OF THE INVENTION

The present invention concerns an ink receptive medium of the type which is preferably used in an ink jet recording process. It is to be understood that within the context of the present disclosure, the term "ink" is meant to refer to all fluid based imaging materials of the type which comprise a solvent and a coloring agent, and coloring agents include pigments, dyes or lakes.

The medium of the present invention includes an image receptor layer at the top surface thereof, and a specific solvent absorbing layer therebeneath. These layers are typically supported upon a substrate, which may include further layers associated therewith. The receptor layer may be fabricated from a variety of materials, and serves to receive the imagewise pattern of ink. A variety of receptor layers may be employed in the practice of the present invention, one particularly preferred receptor layer comprises a gelatin based, pigment loaded layer of the type disclosed in U.S.

Pat. No. 5,532,064 and entitled "Film Article and Method of Making Same", the disclosure of which is incorporated herein by reference.

As will be described in greater detail hereinbelow, in one particularly preferred embodiment, the absorbing layer includes a comb graft copolymer and a water soluble polymer such as polyvinyl pyrrolidone (PVP). This layer is capable of absorbing a wide variety of polar solvents, and functions to draw solvents away from the image receptor layer, thereby producing a dry to the touch, stable image thereupon.

Figure 1:
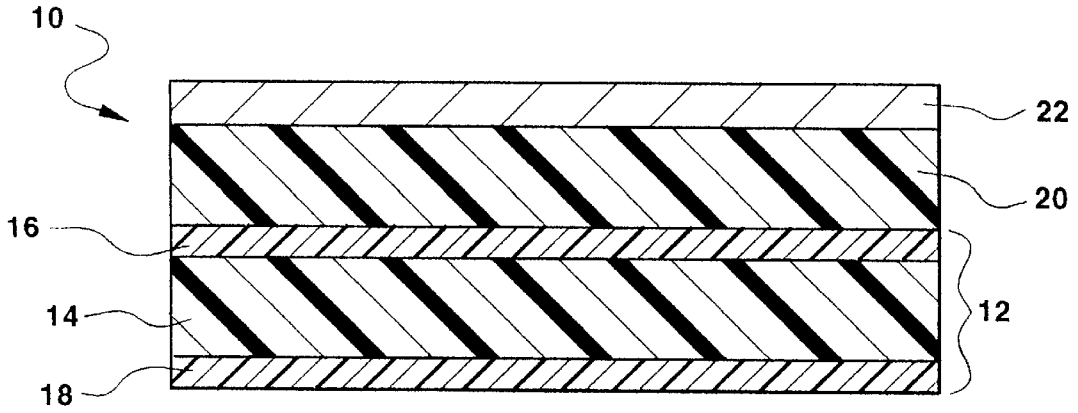
FIG. 1 is a cross-sectional view of one embodiment of imaging medium structured in accord with the principles of the present invention.

Referring now to FIG. 1, there is shown a cross-sectional view of one embodiment of ink jet imaging medium structured in accord with the principles of the present invention. The medium 10 of FIG. 1 includes a substrate 12, which in this particular embodiment is comprised of a support layer 14 which comprises a layer of polyethylene terepthalate of approximately 5 mils thickness. The substrate 12 further includes an anti-static layer 18 on the bottom surface thereof. The anti-static layer 18 is comprised of an electroconductive polymer mixture, which in this embodiment is a body of acrylic polymer having electroconductive particles of antimony doped tin oxide therein. This layer is optional and is not essential to the function of the present invention, but does facilitate handling and use of the sheet. On the top surface of the support layer 14 is a relatively thin subbing layer of an acrylic polymer. This layer provides for improved adhesion of the overlaying absorber layer 20. The acrylic layer 16 is also optional, and may be dispensed with, or substituted for, by other materials.

Atop the substrate 12 is an absorber layer 20 structured in accord with the present invention. The absorber layer 20 is fabricated from a material which has a high absorbtivity for solvents, particularly polar solvents such as water, glycols, glycol ethers and the like. In a particular embodiment of the invention, the absorber layer 20 includes a comb graft copolymer together with a water soluble polymer such as PVP. One particularly preferred comb graft copolymer comprises a material sold by the Soken Corporation of Japan and is available through the Esperit Chemical Company of Florida. This particular comb graft copolymer has an average molecular weight of 35,000 and includes a methyl methacrylate backbone which constitutes 78% of the polymer. Side chains of 2-hydroxy ethyl methacrylate depend from the backbone and constitute 22% of the polymer.

The comb graft polymer is water insoluble but hydrophilic; and it is combined with a water soluble polymer to produce a hydrogel. In general, the water soluble polymer will be present in a smaller amount than the comb graft copolymer. In one specific embodiment, the absorber layer 20 comprises, on a dry weight basis, approximately 64% of the comb graft copolymer and approximately 36% of the polyvinyl pyrrolidone. Within the context of this disclosure, all percentages are given as weight percentages.

It has been found that this combination of polymers provides a layer which is highly absorbent of water and other polar solvents. It has further been found that optimum performance of the media of the present invention is achieved when the absorber layers thereof do not include pigments or other particulate matter of the type disclosed in U.S. Pat. No. 5,190,805. While not wishing to be bound by theory, it is believed that the bibulous properties of this layer are a result of the interaction of the comb graft copolymer and the water soluble polymer. The comb graft copolymer includes a plurality of hydroxyl groups on the side chains thereof which are capable of hydrogen bonding to polar portions of the water soluble polymer. In the instance where PVP is the water soluble polymer, it is believed that bonding is primarily at the nitrogen sites. This hydrogen bonding serves to create a macrostructure in which the water soluble polymer is effectively locked into the water insoluble comb graft copolymer so as to prevent its dissolution. The structure thus provided is capable of absorbing large amounts of water, glycols, alcohols and other such polar solvents, but does not dissolve in those materials.

In accord with one preferred embodiment of the present invention, the absorber layer is prepared from a mixture of the comb graft copolymer and the water soluble polymer selected such that the comb graft copolymer is present in an amount which is equal to, or greater than the amount of the water soluble polymer. The typical range of ratios of comb graft copolymer to water soluble polymer is from approximately 1:1 to 5:1. A more preferred range comprises 1:1 to 3:1, and in some particular embodiments, the comb graft copolymer to water soluble polymer ratio is approximately 2:1.

There are a wide variety of comb graft copolymers which may be utilized in the present invention and such materials will typically comprise a backbone of a hydrophobic material such as methyl methacrylate having side chains grafted thereon of a more polar material such as a hydroxy alkyl methacrylate, polyacrylic acids, polyvinyl pyrrolidone and the like, as are well known to those skilled in the art. The water soluble polymer may similarly comprise any one of a large number of water soluble polymers such as aforementioned PVP, poly N-vinyl-4-methyl-2-oxazolidone and the like.

In accord with the present invention, it has been found that absorber layers thus formed have a very high retention for polar solvents, and provide superior imaging in an ink jet process, without the need for any pigment fillers therein. It is a notable feature of the present invention that the absorber layers can be made pigment free, and as such provide for improved transparency. When utilized in combination with a pigment filled image receptor layer, they provide a superior medium for backlit graphics. It will thus be appreciated that the present invention is a departure from the prior art in that it provides for a decoupling of the solvent absorbing and image formation functions of the ink jet medium thereby allowing superior image quality.

In the illustrated embodiment, the image receptor layer 22 comprises a filled gelatin layer of the type disclosed in U.S. Pat. No. 5,532,064 referred to hereinabove. One particular receptor layer 22 comprises, on a dry weight basis, 35% gelatin which in this embodiment is a photographic, pork skin gelatin available from Kind and Knox, a division of Knox Gelatin Inc., of Sioux City, Iowa, under the designation type A-192, Code No. 243110. The gelatin is present at an approximately 35% weight concentration in the layer and includes approximately 0.6% by weight of a dicyandiamide. The layer further includes approximately 59% by weight of a 50/50 mixture of a precipitated hydrogel silica and titanium dioxide of the rutile type commonly used as a pigment for water based paints. The image receiving layer 22 further includes a color enhancer in the amount of 6% by dry weight. The color enhancer comprises dicyandiamide and functions to adjust the color balance of the resultant layer. The thickness of the receptor layer 22 is typically in the range of 0.15 to 0.05 mil, and in the illustrated embodiment, the layer is 0.09 mil thick.

In the use of the medium 10 of FIG. 1, an imagewise ink pattern is deposited on the receiving layer 22. The ink penetrates the gelatin layer, and the solvents therein are in turn imbibed by the absorbent layer 20 thereby producing a dry to the touch image. It has been found that in those instances where pigment containing inks are employed, the pigment will tend to accumulate in the region of the interface between the absorbing layer 20 and the image receiving layer 22. Likewise, dye based or lake based images will also tend to localize in this region. The presence of the absorbing layer prevents image spread and permits the image receiving layer 22 to maintain a non-tacky, relatively dry surface. Images produced in this manner are very suitable for backlit imaging application, in which light is projected through the image receiving layer 22 so that it may be viewed through the substrate 10.

Figure 2:
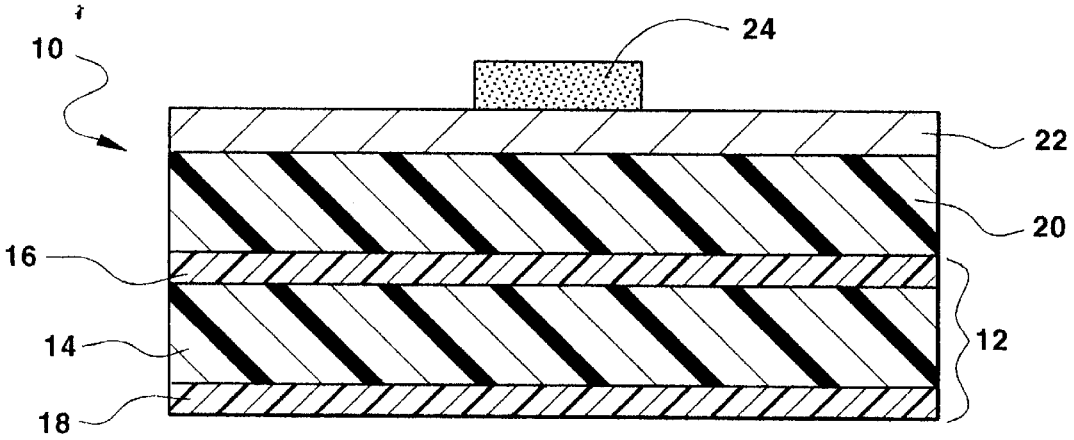
FIGS. 2–4 are cross-sectional views of the imaging medium of FIG. 1 at various stages of its use in a recording process.

The operation of the present invention will be discussed in greater detail with reference to FIGS. 2–4 which depict the formation of an image on a medium which is generally similar to that illustrated at reference numeral 10 in FIG. 1. As shown in FIG. 2, body of ink 24 is deposited in an imagewise manner, onto the top surface of the image receptor layer 22 of the medium 10. As mentioned hereinabove, the ink comprises a coloring agent disposed in a polar solvent such as a mixture of glycols and/or glycol ethers with or without water. As further noted, the image receptor layer 22 typically includes a relatively high loading of pigment material therein; however, operation of the invention is generally similar in the absence of the particulate material.

Figure 3:
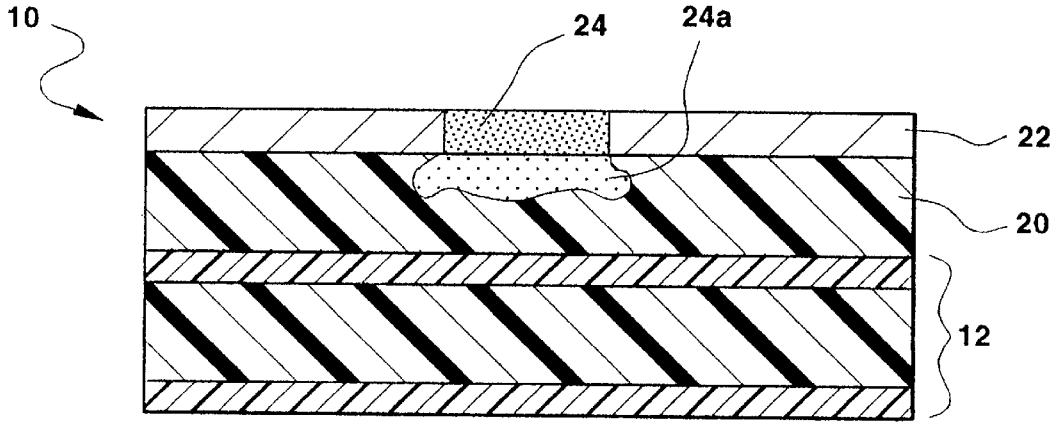

Referring now to FIG. 3, there is shown the same layer of imaging medium 10 having the body of ink 24 partially penetrated thereinto. As noted above, the absorber layer 20 has a relatively higher affinity for the polar solvent component of the ink than it does for the coloring agent. As a consequence, the absorber layer 20 tends to draw solvent out of the body of ink thereby causing the ink to "dry" within the imaging medium. As shown in FIG. 3, a volume of solvent 24*a* has been drawn into the absorber layer 20 from the main body of ink 24 which is primarily contained within the receptor layer 22.

Figure 4:
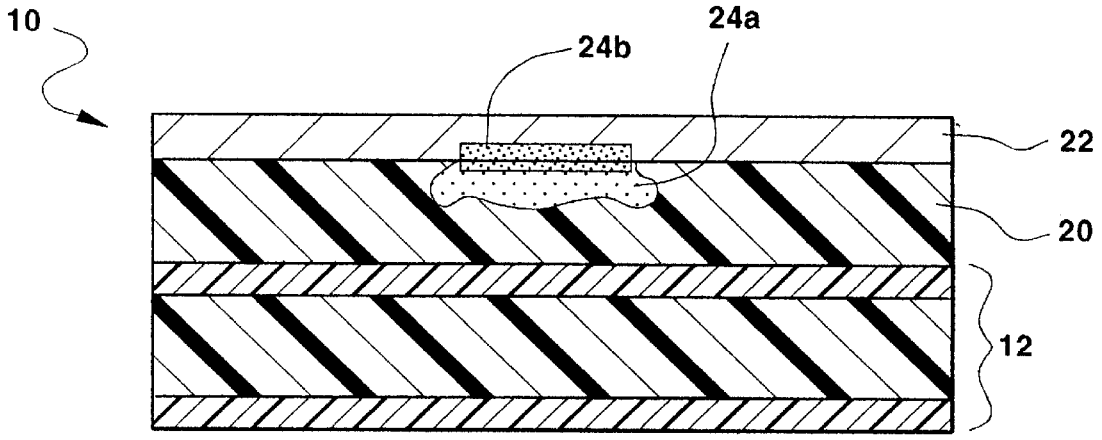

As is best seen with regard to FIG. 4, the drawing away of solvent by the absorber layer tends to localize the image, as formed by the coloring agent of the ink, to the region of the interface between the absorber layer 20 and receptor layer 22. As illustrated, the solvent component of the ink 24*a* is primarily drawn into the absorber layer 20 while the coloring agent portion 24*b* of the ink remains localized near the interface. As a result of the foregoing, the final imaged medium presents a dry to the touch surface. Additionally, image spread is minimized. Localization of the image at the interface region produces very sharp, saturated color, readily visible through the substrate 12. In those instances where the absorber layer 20 is a relatively transparent, homogeneous layer free of particulate materials, the image may be readily viewed through the substrate side of the medium 10. In those instances where the receptor layer 22 is filled with a pigment material, that layer 22 will provide a light diffusive background for viewing of the image. Accordingly, a structure of this type is ideally suited for use in the preparation of backlit images of the type utilized in lighted graphic displays.

Because the imaged medium of the present invention provides a dry to the touch, high resolution image it may be adapted to use in a variety of processes. As noted above, the image medium may be utilized for a backlit display without any further modification. The image medium may also be laminated onto a variety of stock to provide decals, posters, banners and the like.

Figure 5:
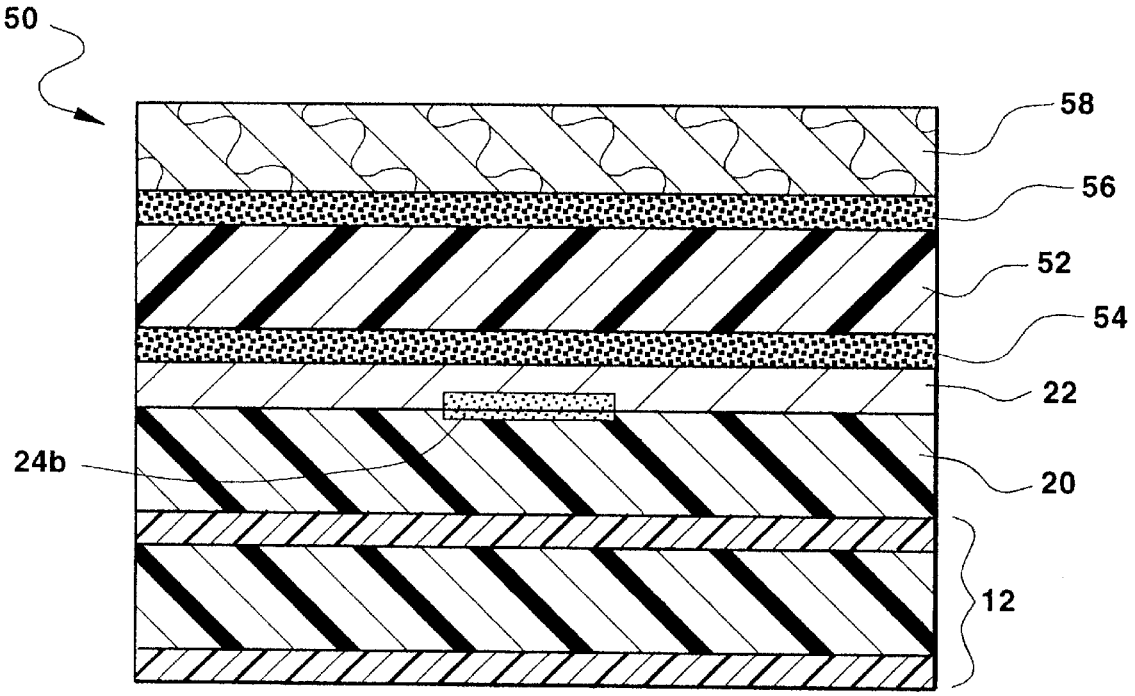
FIG. 5 is a cross-sectional view of another embodiment of the present invention.

Referring now to FIG. 5, there is shown another embodiment of the present invention as adapted for use in the manufacture of an adhesive display item 50. The display item 50 has some general similarities to the imaged medium described with reference to FIGS. 1–4; and accordingly, like structures will be referred to by like reference numerals.

The imaged structure 50 of FIG. 5 is fabricated from an imaged sheet of medium generally similar to that previously described and including a substrate 12, an absorber layer 20 and a receptor layer 22. An image is defined in the medium by a body of coloring agent 24*b* as previously described. The structure 50 of FIG. 5 differs from that shown in FIG. 4 insofar as a further plurality of layers is disposed thereupon after formation of the ink jet image.

As illustrated, a body of support material 52 is adhered to the receptor layer 22 by a body of adhesive 54. This support 52 may comprise a transparent support such as a layer of vinyl polymer, or a layer of fluoropolymer such as Tedlar® sold by the DuPont Corporation. In other instances, the layer may comprise an opaque layer such as a layer of polymer, paper, metal or the like. Inclusion of the further support layer protects the imaged member and can also provide support in those instances where the imaged member is to be employed as a free standing sign, poster or other such display element. As is further illustrated with regard to FIG. 5 yet another set of layers 56 and 58 may also be included. For example, a further layer of a pressure sensitive adhesive 56 may be disposed upon the support layer 52, and in turn is protected by a release layer 58. A structure of this type may be employed as a decal, bumper sticker, label or the like, in which instance release layer 58 is simply stripped away, and the imaged member adhered to a substrate by pressure contact. In view of the teaching presented herein, yet other variations of the present invention will be apparent to those of skill in the art.

There are a variety of techniques by which the structure of FIG. 1 may be prepared. In one particular process, the substrate layer 12 comprised a support layer of polyethylene terepthalate 14 having an anti-static layer 18, and an acrylic coating 16 thereupon. This material is available commercially from the ICI Corporation under the designation 505, although a variety of other substrate materials may be used in this invention. An absorber layer 20 was coated onto the substrate 12 by a solvent coating process. To prepare the coating solution for this layer 7% by weight of the comb graft copolymer referred to above and 4% by weight of polyvinyl pyrrolidone grade K-90, supplied by GAF Inc., and having a molecular weight of 300,000, were blended in 89% by weight of a solvent comprising propylene glycol monomethyl ether, so as to produce a homogenous solution having a viscosity of approximately 60 cps at room temperature, (other solvents such as a 50:50 blend of acetone and methanol may be similarly employed). This solution was coated onto the substrate utilizing a wire bar coating process. The coating was dried at 190° F. for 2½ to 3 minutes to produce a layer of approximately 0.22 mils; and a gelatin based image receiving layer as previously described was applied thereto. The gelatin was prepared by blending together by weight, an aqueous mixture of 59 parts of a silica/titanium dioxide pigment, 35 parts of the gelatin and 6 parts of the color enhancer. Mixing was carried out at room temperature, and the resultant mixture coated onto the absorbent layer in a wire bar process. The coating was dried at 190° F. for 2½ to 3 minutes, to produce a structure of approximately 0.45 mils thickness, after which the resultant medium was ready for use. It was found that the product thus produced gave superior results in an ink jet imaging process utilizing inks including glycol solvents, water solvents and glycol ether solvents. The images thus produced were dry to the touch and did not block, smear or spread.

It will be appreciated that other modifications and variations of the foregoing may be implemented in accord with the present invention. For example, the material of the present invention may be coated onto a variety of substrates including paper substrates as well as polymeric substrates. As noted above, the substrates may include one or more auxiliary layers to enhance coating adhesion, eliminate static and the like. The absorbing layer of the present invention may be employed in connection with a number of different image receptive layers, other than the gelatin based layer disclosed herein. The absorbing layer of the present invention is not limited to use in ink jet imaging processes. The materials produced through the present invention may also be used for other applications wherein a liquid ink is transferred to a substrate, including printing processes, painting processes, electrostatic imaging and the like. In view of the foregoing, it will be appreciated that numerous modifications and variations of the present invention may be practiced within the context of the disclosure herein. The foregoing drawings, discussion, description and example are merely meant to illustrate particular embodiments of the invention and are not meant to be limitations upon the practice thereof.

I claim:

1. A medium for use in an imaging process which employs an ink comprising a coloring agent and a polar solvent, said medium comprising:

a support substrate;

an absorber layer supported on said substrate, said absorber layer consisting essentially of a hydrogel formed from a water insoluble, hydrophilic polymer and a water soluble polymer, said hydrogel having a higher affinity for a polar solvent of an ink than for a coloring agent therein;

an image receptor layer supported by said absorber layer, in direct contact therewith, said image receptor layer having a higher affinity for the coloring agent of said ink than for the polar solvent thereof; whereby, when said ink is applied to said medium, the absorber layer draws the polar solvent from the ink and the coloring agent in said ink is localized in the region of the interface of said absorber layer and said image receptor layer.

2. A medium as in claim 1, wherein said hydrogel is comprised of an amount of said water insoluble, hydrophilic polymer which is at least as great as the amount of said water soluble polymer.

3. A medium as in claim 2, wherein the weight ratio of said water insoluble, hydrophilic polymer to said water soluble polymer is in the range of 1:1–5:1.

4. A medium as in claim 2, wherein the weight ratio of said water insoluble, hydrophilic polymer to said water soluble polymer is in the range of 1:1–3:1.

5. A medium as in claim 1, wherein said water insoluble, hydrophilic polymer comprises comb graft copolymer.

6. A medium as in claim 5, wherein said comb graft copolymer comprises a methyl methacrylate backbone having side chains of a hydroxy alkyl acrylate polymer dependent therefrom.

7. A medium as in claim 5, wherein said comb graft copolymer has an average molecular weight of 35,000 and comprises 78% of a methyl methacrylate backbone having 22% of side chains of 2-hydroxyethyl methacrylate dependent therefrom.

8. A medium as in claim 1, wherein said water soluble polymer is selected from the group consisting of: polyvinyl pyrrolidone, poly N-vinyl-4-methyl-2-oxazolidone, and combinations thereof.

9. A medium as in claim 1, wherein said absorber layer is a homogeneous layer free of any undissolved particulate material.

10. A medium as in claim 1, wherein said image receptor layer includes an undissolved particulate material dispersed therein.

11. A medium as in claim 10, wherein said particulate material comprises, by weight, at least 50% of said receptor layer.

12. A medium as in claim 1, wherein said image receptor layer comprises a layer of gelatin.

13. A medium as in claim 12, wherein said gelatin further includes dicyandiamide therein.

14. A medium as in claim 1, wherein the thickness of said image receptor layer is in the range of 0.1–1.0 mil.

15. A medium as in claim 1, wherein the thickness of absorber layer is in the range of 0.1–1.0 mil.

16. A medium for use in an ink jet imaging process which employs an ink comprising a coloring agent and a polar solvent, said medium comprising:

a support substrate;

an absorber layer supported on said substrate, said absorber layer comprising a water insoluble, hydrophilic, comb graft copolymer complexed with a water soluble polymer so as to form a hydrogel, said water soluble polymer being present in a weight amount which is less than or equal to the weight amount of said comb graft copolymer;

an image receptor layer supported by said absorber layer, in direct contact therewith, said image receptor layer comprising gelatin having dicyandiamide dissolved therein and a particulate material dispersed therein.

17. A medium as in claim 16, wherein the particulate material in said image receptor layer comprises, by weight, 40–60% of said image receptor layer.

18. A medium as in claim 16, wherein said particulate material comprises a mixture of silica and titanium dioxide.

* * * * *

UNITED STATES PATENT AND TRADEMARK OFFICE

CERTIFICATE OF CORRECTION

PATENT NO. : 5,888,629

DATED : March 30, 1999

INVENTOR(S) : Michael J. Lubar

It is certified that error appears in the above-identified patent and that said Letters Patent is hereby corrected as shown below:

Column 8, line 30, after "of" insert "said".

Signed and Sealed this

Eighteenth Day of May, 1999

*Attest:*

Q. TODD DICKINSON

*Attesting Officer*

*Acting Commissioner of Patents and Trademarks*